US005207456A

United States Patent [19]

Danhoff

[11] Patent Number: 5,207,456

[45] Date of Patent: May 4, 1993

[54] LAY FLAT HINGE BINDING

[75] Inventor: Ronald S. Danhoff, Plymouth, Ohio

[73] Assignee: R.R. Donnelley & Sons Company, Lisle, Ill.

[21] Appl. No.: 866,485

[22] Filed: Apr. 10, 1992

[51] Int. Cl.[5] ..... B42D 5/00

[52] U.S. Cl. ..... 281/40; 281/29

[58] Field of Search ..... 281/40, 41, 3.1, 15.1, 281/21.1, 29, 35, 36; 412/19, 22, 24

[56] References Cited

U.S. PATENT DOCUMENTS

| | | | |
|---|---|---|---|
| 379,334 | 3/1888 | Ryan | 281/40 |
| 438,067 | 10/1890 | Dunn . | |
| 649,061 | 5/1900 | Leechman . | |
| 696,281 | 3/1902 | Toole | 281/41 |
| 711,900 | 10/1902 | Jones | 281/41 |
| 855,049 | 5/1907 | Diehl | 281/41 |
| 863,988 | 8/1907 | Hansen | 281/41 |
| 1,199,280 | 9/1916 | Krumming | 281/41 |
| 1,551,142 | 8/1925 | Franz, Jr. | 281/40 |
| 1,897,839 | 2/1933 | Gale . | |
| 1,913,320 | 6/1933 | Woodward . | |
| 1,942,399 | 1/1934 | Gale | 281/40 |
| 1,962,407 | 6/1934 | Pierce | 281/40 |
| 4,911,475 | 3/1990 | Lerman | 281/51.1 |

FOREIGN PATENT DOCUMENTS

| | | | |
|---|---|---|---|
| 3454 | of 1882 | United Kingdom | 281/40 |

*Primary Examiner*—Mark Rosenbaum
*Assistant Examiner*—Willmon Fridie, Jr.
*Attorney, Agent, or Firm*—Marshall, O'Toole, Gerstein, Murray & Bicknell

[57] ABSTRACT

A book according to the present invention has a front cover and a back cover joined by a spine. A plurality of pages are bound to each other and to the cover near the spine. All or nearly all of the pages have a lay flat hinge so that the book will lie flat when opened. The lay flat hinge comprises a weakened portion, a first non-weakened portion between the weakened portion and a head of a page, and a second non-weakened portion between the weakened portion and a foot of the page. The weakened portion allows the book to lie flat when opened and the first and second non-weakened portions prevent pages from being easily torn from the book and prevent the weakened portion from being visible along edges of the book.

14 Claims, 2 Drawing Sheets

LAY FLAT HINGE BINDING

FIELD OF THE INVENTION

The present invention relates to books having pages provided with lay flat hinges so that the books will lie flat when opened.

BACKGROUND OF THE INVENTION

Soft covered books, such as manuals, textbooks, catalogs and magazines, and hardbound books do not readily lie flat when opened. Such books often suffer a "mousetrap" effect wherein, when the books are opened, they tend to close of their own accord and must be held open by the user or by an artificial device external to the books.

Various modifications of the books or of the pages of the books have been attempted in the past to overcome this "mousetrap" effect. For example, one arrangement, shown in U.S. Pat. No. 1,897,839, uses a score to weaken each page of a book from the head of the page to its foot. This weakening of the pages negates the "mousetrap" effect and allows the book to lie flat when opened. Because the pages have been scored from head to foot, an indentation is visible at the head and foot of each page. The indentations of all of the pages result in a V-shaped line being visible at the top and bottom edges of the book. Had the pages not been spatially shifted, the line would have appeared as a straight line. Other arrangements use perforations instead of scoring. Still other arrangements use a modified spine arrangement such that the spine of the book bends in a concave manner when the book is opened in order to flip the pages in a manner to maintain the book opened.

These arrangements suffer many disadvantages. For example, when the pages are scored or perforated from the head of each page to the foot of each page, the pages of the book can be weakened to the point where they can be accidentally torn from the book. Moreover, as discussed above, a head to foot scoring or series of perforations produces an undesired visible line when the book is viewed along its top and bottom edges. Furthermore, a special spine arrangement is expensive and difficult to construct.

SUMMARY OF THE INVENTION

The present invention avoids these disadvantages by providing a hinge for the pages of a book which weakens the pages sufficiently that the book will lie flat when opened but not so much that the pages can be easily torn from the book. This hinge also is not visible at the edges of the book.

According to one aspect of the present invention, a page to be bound in a book has a head, a foot, and a hinge. The hinge includes a weakened portion, a first non-weakened portion between the weakened portion and the head of the page, and a second non-weakened portion between the weakened portion and the foot of the page. The weakened and non-weakened portions permit the book to lie flat when it is opened but do not permit the weakened pages to be easily torn from the book. The non-weakened portions also have the advantage that the weakened portion is not visible along the edges of the book.

According to another aspect of the present invention, a book has a front cover and a back cover joined by a spine. A plurality of pages, each having a head and a foot, are bound to each other and to the cover near the spine. At least a majority of the pages have a weakened portion. These pages also have a first non-weakened portion between the weakened portion and the head of the pages, and a second non-weakened portion between the weakened portion and the foot of the pages. The weakened and non-weakened portions permit the book, when opened, to lie flat but do not permit the pages to be easily torn from the book. The non-weakened portions also have the advantage that the weakened portion is not visible along the edges of the book.

According to a further aspect of the present invention, a method of making a flat-opening book includes the step of weakening each of a plurality of pages of the book by an amount which, when the book is opened, will allow the book to lie flat, but will not allow the pages to be easily torn from the book, and will not allow a line to be visible along the edges of the book.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
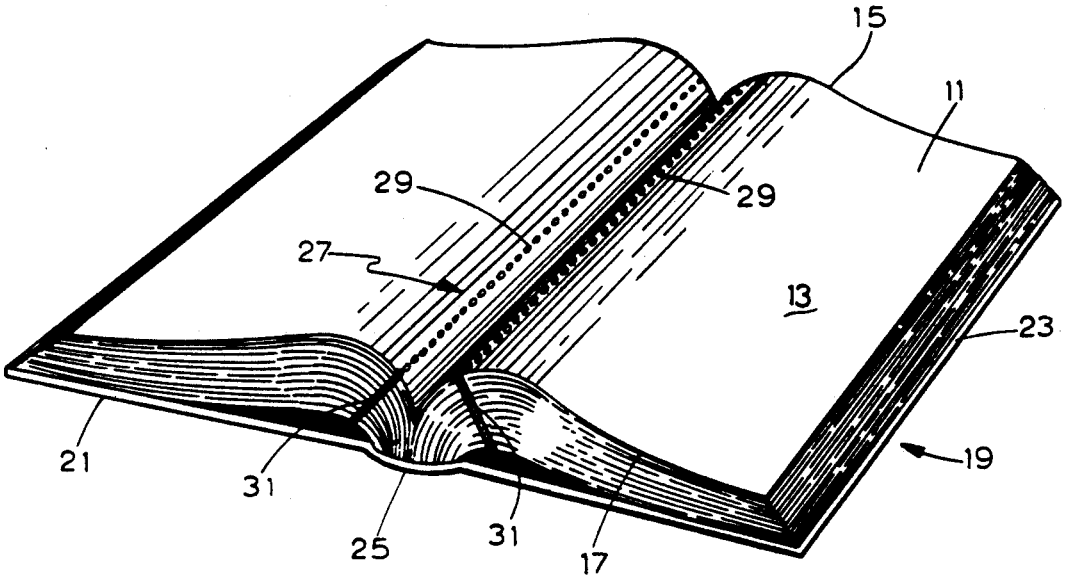
FIG.1 PRIOR ART
FIG. 1 shows an opened prior art book.
Figure 2:
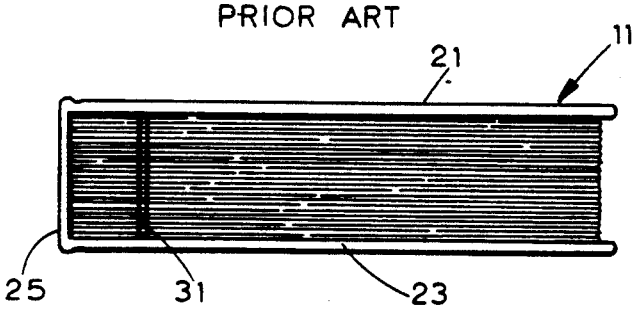
FIG. 2 PRIOR ART
FIG. 2 shows a line 19 which is evident along an edge of the prior art book shown in FIG. 1 and which results from weakening the pages of the book.

As shown in FIG. 1, a prior art book 11 has a plurality of pages 13 each of which has a head or top edge 15 and a foot or bottom edge 17. A cover 19 of the book comprises a front cover 21 and a back cover 23 joined by a spine 25. The pages 13 are suitably bound together and to the cover 19 of the book 11. A hinge 27, formed by a plurality of perforations 29, extends entirely from the head 15 to the foot 17 of each page 13. Because the perforations extend substantially from the head 15 to the foot 17 of the pages 13, the pages 13 of the book 11 are weakened, particularly after repeated turning of the pages 13, to the point where a page can be accidentally torn from the book 11. Moreover, if the first and last of the perforations 29 are intersected by the head 15 and the foot 17, respectively, of the pages 13 (as shown in FIG. 1), these intersected perforations will leave a visible line along both the head and the foot of the book 11. The visible line at the foot 17 of the book 11 is shown as a visible hinge line 31 in FIGS. 1 and 2.

Figure 3:
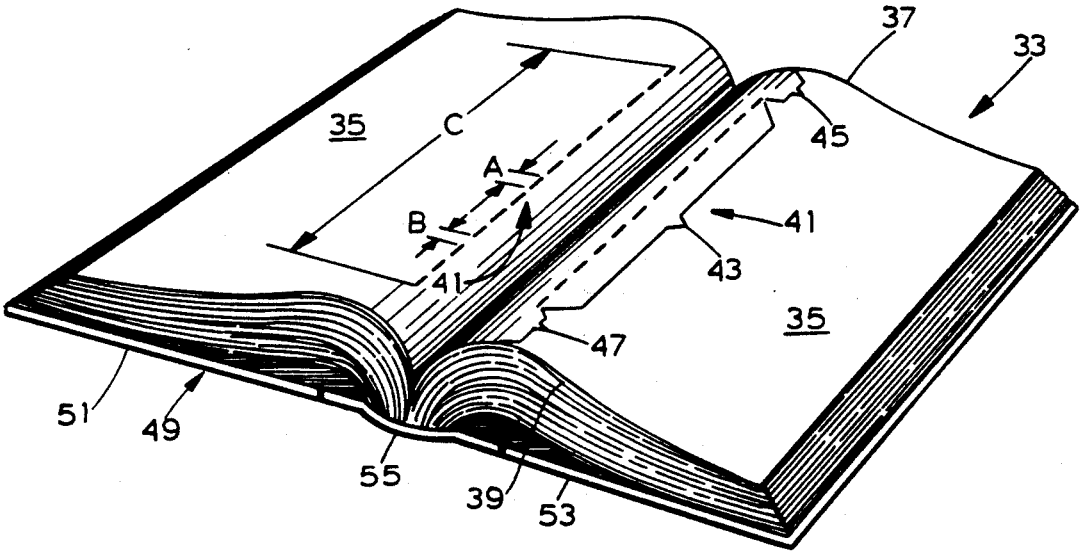
FIG. 3 shows an opened book having weakened pages according to the present invention.
Figure 4:
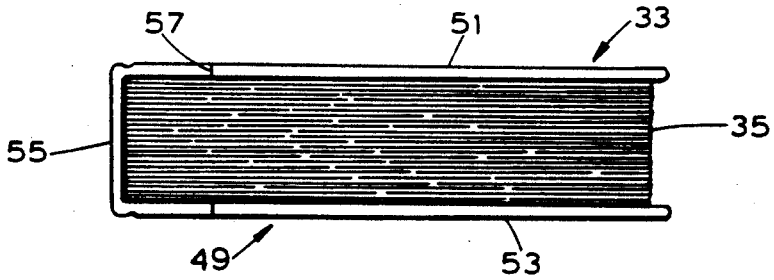
FIG. 4 shows an edge of the book of FIG. 3.
Figure 5:
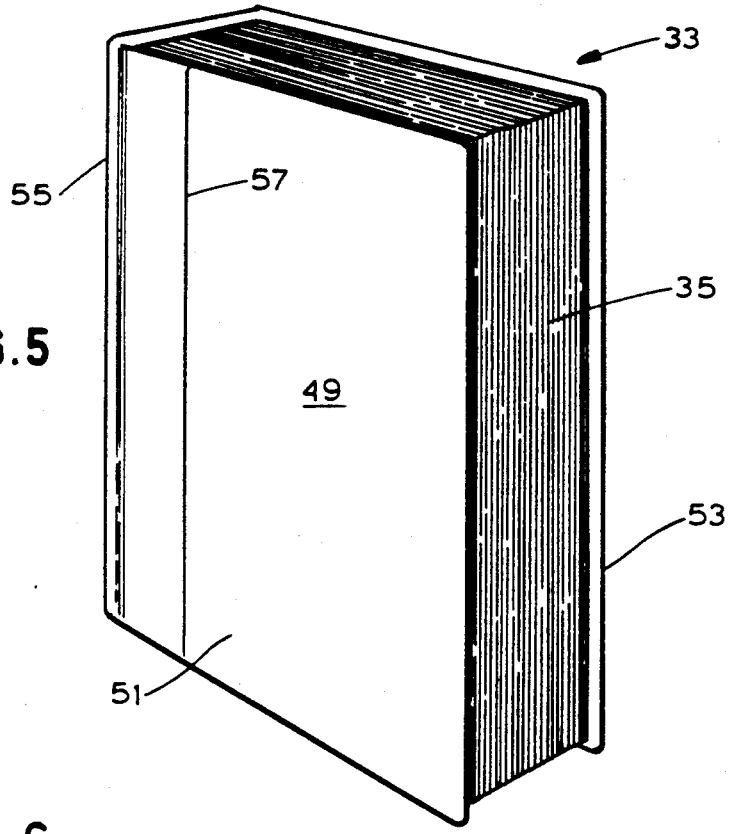
FIG. 5 shows a perspective view of a book according to the present invention.

One embodiment of a book 33 according to the present invention is shown in FIGS. 3–5. The book 33 has a plurality of pages 35 each of which has a head or top edge 37 and a foot or bottom edge 39. Each page also has a lay flat hinge 41 comprising a weakened portion 43 in the form of a plurality of perforations, a non-weakened portion 45 between the weakened portion 43 and the head 37 of the pages 35, and a non-weakened portion 47 between the weakened portion 43 and the foot 39 of the pages 35. The non-weakened portions 45 and 47 have no perforations. As noted in greater detail hereinafter, the perforations in the weakened portion 43 are shown as slits although they could be holes, such as in the case of the perforations 29 shown in FIG. 1, or any other geometric shape.

When the book 33 is opened, the weakened portions 43 of the lay flat hinges 41 of the pages 35 allows the book to lie flat. At the same time, the non-weakened portions 45 and 47 of the lay flat hinges 41 provide strength for the pages 35 so that the pages cannot be easily torn from the book. Also, as shown in FIGS. 3 4, and 5, no hinge line is visible at the head 37 or the foot 39 of the pages 35.

As shown in FIG. 3, the weakened portion 43 preferably has a plurality of perforations in the form of slits each having a suitable slit length A. Also, adjacent slits are separated by a suitable separation distance B. The slits may all have equal lengths or not as desired, and the separation distances B between adjacent pairs of slits may all have equal lengths or not as desired. In the preferred embodiment, however, the lengths A of the slits are equal and the lengths of the separation distances B between adjacent pairs of slits are equal. Generally, the weakened portion 43 has an overall length C such that the length C is determined by the following equation:

$$C = \sum_{i=1}^{n} A_i + \sum_{j=1}^{n-1} B_j$$

where n is equal to the number of slits, $A_i$ is the length of the $i^{th}$ slit, and $B_j$ is the length of the $j^{th}$ separation distance. Although the sum of all the slit lengths A can comprise any percentage of the length C, it has been found that, if the sum of all slit lengths A is equal to about 40% of C, the book 33 will lie flat when opened. It has also found that, if the sum of all separation distances B is equal to about 60% of C and the non-weakened portions 45 and 47 each have a length of about 0.75 inch, the hinges 41 of the pages 35 will have sufficient strength that the pages 35 cannot be easily torn from the book 33. The length of the non-weakened portions 45 and 47 can be of any desired length, however, as long as they, in combination with the sum of all separation distances B provide sufficient strength so that the pages 35 cannot be easily torn from the book 33. For example, in short books (such as those which are 6" from head to foot) where the lengths of the non-weakened portions 45 and 47 would otherwise be a significant percentage of the length of the book, it may be necessary to shorten the non-weakened portions 45 and 47. Thus, the sum of the slit lengths A, the sum of the separation distances B, and the lengths of the non-weakened portions 45 and 47 can be varied with respect to one another as long as the hinge retains strength but yet allows the book to lie flat.

If the perforations are holes, then the length A is the diameter of the hole. If the perforations have any other geometric shape, the length A is the dimension of the geometric shape running along a line parallel to the spine of the book.

A cover 49 of the book 33 has a front cover 51 and a back cover 53 joined by a spine 55. As mentioned previously, a book according to the present invention can have a soft cover or a hard cover. If the cover is soft, the front cover 51 may have a score line 57 as shown in FIGS. 4 and 5 in order to facilitate the book lying flat when it is opened. (The back cover 53 may have a score line as well.) Although the hinges 41 of the pages 35 may be any desired distance from the spine 55 of the book 21, such as 0.25 inch, the hinges 41 of the pages 35 are preferably farther away from the spine 55 of the book 33 than are the score lines of the cover 49. (For example, the score line 57 may be 0.0625 inch closer to the spine 55 than are the hinges 41.) If the book has a hard cover, the hard cover and the pages may be bound together with a patent binding. If so, and if the pages of the book have the hinge 41 shown in FIG. 3, the book 33 will lie flat when opened.

Figure 6:
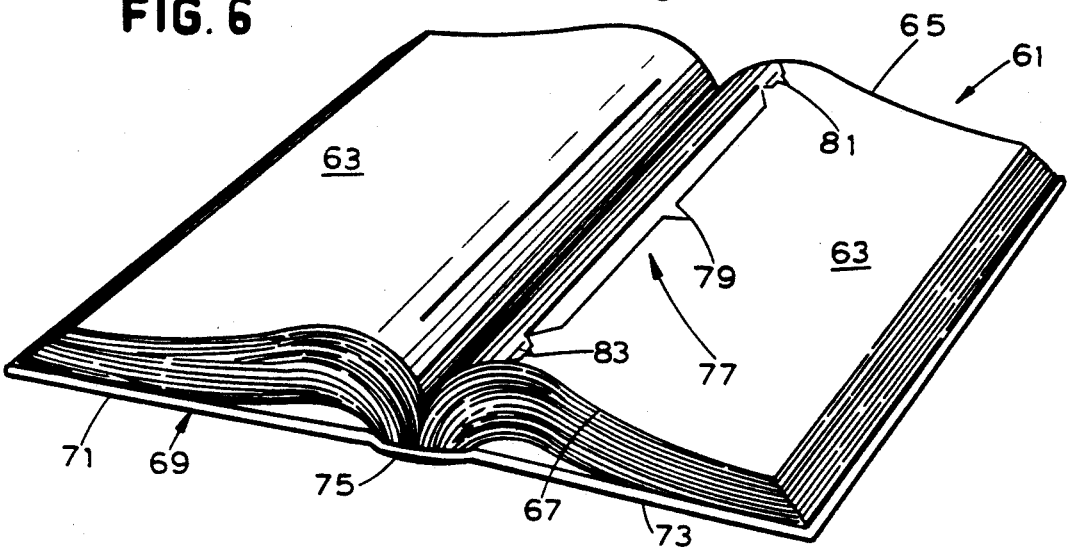
FIG. 6 shows another embodiment of the present invention.

A further embodiment of the lay flat hinge according to the present invention is shown in FIG. 6. The book 61 shown in FIG. 6 has a plurality of pages 63 each having a head or top edge 65 and a foot or bottom edge 67. The pages 63 of the book 61 are bound together, such as by a patent binding, and to a cover 69 formed by a front cover 71 and a back cover 73 joined by a spine 75. Each page 63 of the book 61 is provided with a lay flat hinge 77 having a weakened portion 79, in the form of a score or linear depression of the page. The hinge 77 also has a non-weakened portion 81 between the weakened portion 79 and the head 65 of the page 63, and a non-weakened portion 83 between the weakened portion 79 and the foot 67 of the page 63. The weakened portion 79 allows sufficient flexibility of each page 63 of the book 41 so that the book 61 will lie flat when opened. The non-weakened portions 81 and 83 provide sufficient strength for each of the pages 63 to prevent the pages 63 from being easily torn from the book 61 and enhance the aesthetic appearance of the book by preventing the appearance of hinge lines at the head 65 and the foot 67 of the pages 63.

Although preferable, it may not be necessary to provide a lay flat hinge on every page of a book as long as a sufficient number of pages have a lay flat hinge so that the book lies flat when opened. This and other modifications will be apparent without departing from the scope of the present invention which is limited only by the following claims.

What is claimed is:

1. A lay flat hinge for a page to be bound in a book, said page having a head edge, a foot edge, and first and second side edges between said head edge and said foot edge, said first side edge adapted to be bound in said book, said lay flat hinge comprising:

a weakened portion between said head edge and said foot edge of said page, said weakened portion facilitating a book in lying flat when the book is opened, said weakened portion including a plurality of slits each having a slit length which is substantially parallel to said first side edge of the page;

a first non-weakened portion between said weakened portion and said head edge of said page; and, a second non-weakened portion between said weakened portion and said foot edge of said page;

wherein said weakened portion and said first and second non-weakened portions prevent said page from being easily torn from said book and prevent said weakened portion from being visible along said head edge and said foot edge of said page.

2. The lay flat hinge of claim 1 wherein each of said slits is separated from an adjacent slit by a separation distance, wherein said weakened portion has a total length equal to the sum of said slit lengths of all of said slits and of said separation distances between all adjacent slits, and wherein the sum of said slit lengths of all of said slits is about 40% of said total length of said weakened portion.

3. The lay flat hinge of claim 2 wherein each of said non-weakened portions has a length of about 0.75 inch.

4. The lay flat hinge of claim 1 wherein each of said non-weakened portions has a length of about 0.75 inch.

5. A method of making a flat opening book comprising the following steps:

weakening a plurality of pages by an amount which, when said pages are bound into a book and said book is opened, will allow said book to lie flat, which will not allow said pages to be easily torn from said book, and which will preclude a hinge line from being visible along edges of said book;

weakening a cover so as to facilitate said book lying flat when said plurality of pages are bound to said cover and said book is opened; and, binding said plurality of said pages to each other and to said cover.

6. The method of claim 5 wherein said step of weakening said plurality of pages comprises the step of perforating each of said plurality of pages along a predetermined length thereof.

7. The method of claim 6 wherein each of the perforations resulting from said step of perforating each of said plurality of pages along a predetermined length thereof has a perforation length and wherein the sum of all of said perforation lengths is about 40% of said predetermined length.

8. The method of claim 7 wherein said step of weakening said cover comprises the step of weakening said cover closer to a spine of said book than is said weakening of said plurality of pages.

9. The method of claim 5 wherein said step of weakening said cover comprises the step of weakening said cover closer to a spine of said book than is said weakening of said plurality of pages.

10. A book having a cover and a plurality of pages each of which is bound to each other and to said cover near a spine of said cover, each of a majority of said pages comprising:

a head;

a foot;

means including a plurality of slits for weakening said each of said majority of said pages so that said book will lie flat when said book is opened;

a first non-weakened portion between said means and said head of said each of said majority of said pages; and, a second non-weakened portion between said means and said foot of said each of said majority of said pages;

wherein said first and second non-weakened portions also prevent said means from being visible along edges of said book.

11. The book of claim 10 wherein said cover comprises front and back covers each of which has weakened portions so that, when said book is opened, said front and back covers will facilitate said book lying flat.

12. The book of claim 11 wherein said weakened portions of said front and back covers are closer to said spine than is said means.

13. The book of claim 12 wherein said means comprises a plurality of perforations.

14. The book of claim 13 wherein each of said perforations has a perforation length, wherein each of said perforations is separated from an adjacent perforation by a separation distance, wherein said means has a length equal to the sum of said perforation lengths of all of said perforations and of said separation distances between all adjacent perforations, and wherein the sum of said perforation lengths of all of said perforations is about 40% of said length of said means.

* * * * *